United States Patent [19]

Jansz

[11] 4,051,685

[45] Oct. 4, 1977

[54] POSITIONING METHOD AND APPARATUS FOR SUBMERSIBLE PILE DRIVING

[75] Inventor: Joost W. Jansz, The Hague, Netherlands

[73] Assignee: Hollandsche Beton Groep N.V., Rijswijk, Netherlands

[21] Appl. No.: 681,937

[22] Filed: Apr. 30, 1976

[30] Foreign Application Priority Data

Oct. 13, 1975 Netherlands ..... 7512021

[51] Int. Cl.[2] ..... E02D 7/10

[52] U.S. Cl. ..... 61/53.5; 173/DIG. 1; 175/6

[58] Field of Search ..... 61/53.5, 63, 69; 175/6; 173/DIG. 1

[56] References Cited

U.S. PATENT DOCUMENTS

| | | | |
|---|---|---|---|
| 26,073 | 11/1859 | Whipple | 173/DIG. 1 |
| 3,434,551 | 3/1969 | Rosfelder | 175/6 |
| 3,491,842 | 1/1970 | Delacour et al. | 175/6 |
| 3,795,114 | 3/1974 | DeCremiers et al. | 61/69 R |

*Primary Examiner*—Jacob Shapiro

*Attorney, Agent, or Firm*—Sughrue, Rothwell, Mion, Zinn and Macpeak

[57] ABSTRACT

A pile driving apparatus to be lowered onto the head of a previously submerged pile positioned in a caisson is guided in its descent on cables. The cables are secured to a crossbar attached near the head of the pile. The crossbar must be attached sufficiently close to the head of the pile so that the funnel shaped mouth of the pile driving apparatus is guided onto the head of the pile even if the surface ship has drifted laterally to pull the cables away from the vertical, or if the pile itself is positioned in the caisson at an angle to the vertical.

The crossbar is attached to the pile by retractable pins extending through longitudinal slots in the pile, or by extendable pressure pads that engage the circumference of the pile. Means are provided for automatically retracting the pins or pads whenever the crossbar bears against the pile driving apparatus.

4 Claims, 14 Drawing Figures

FIG. 8
FIG. 7
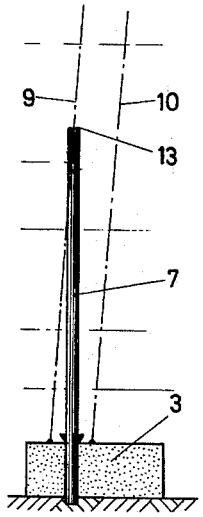
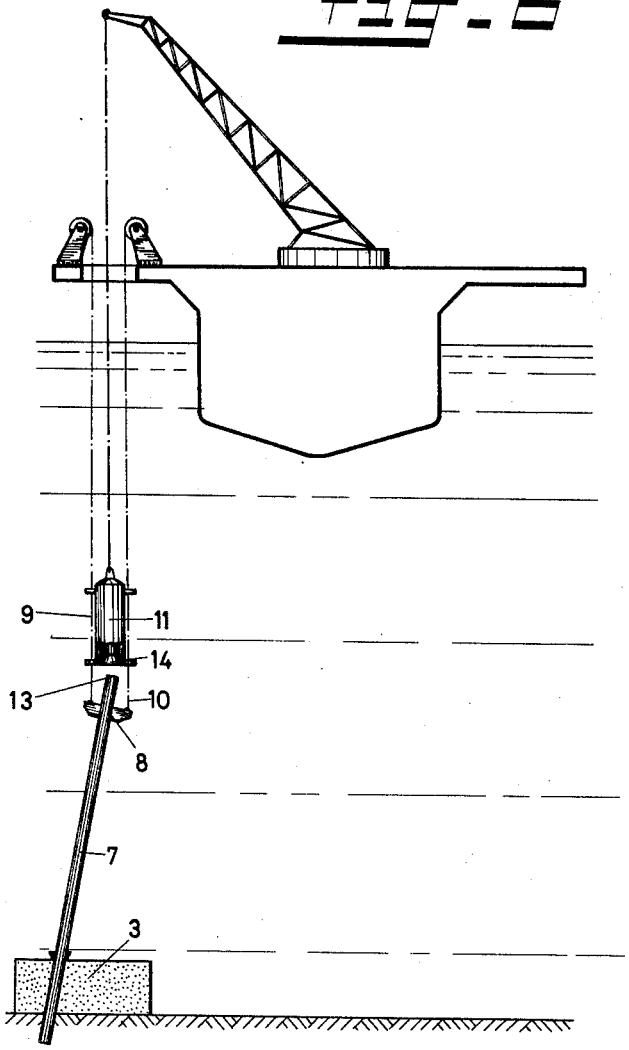

POSITIONING METHOD AND APPARATUS FOR SUBMERSIBLE PILE DRIVING

BACKGROUND OF THE INVENTION

1. Field of the Invention

The invention relates to a method and apparatus for positioning a pile driving head from a vessel onto the top of a pile or similar body at a considerable depth under water. The pile driving head is lowered on guide cables which run downwards from the vessel towards the pile and are secured in such a manner that the pile driving head is positioned over the pile.

2. Description of the Prior Art

The prior art discloses the method of lowering a pile driving head onto the top of a previously positioned pile which has its lower end inserted into the bore of a caisson placed on the ocean bottom to hold the pile in the correct position for pile driving. The pile driving head is lowered towards the pile being guided by cables running from the vessel towards the caisson which are kept taut by means of swell compensators. If the vessel remains directly over the pile, the pile driving head can be lowered over the pile without difficulty. In practice, deviations in a lateral direction will occur, with the result that the guide cables at the level of the top of the pile are laterally displaced from the pile. Consequently, the pile driving head canot be lowered directly over the pile.

This problem does not occur only when moving a pile driving head towards a pile but wherever guide cables are used to position a device onto a section of a previously lowered body. Pile driving at great depths causes considerable problems necessitating the assistance of divers, underwater television and sonar to determine the position of the cables with respect to the pile. If the piles are of considerable length, e.g., 100m, there may be a substantial deviation between the guide cables and the top of the pile.

SUMMARY OF THE INVENTION

It is an object of this invention to provide a simple method and apparatus for positioning a pile driving head onto a pile. This object is achieved in that prior to lowering the head, a crossbar with the guide cables running therethrough is attached near the upper section of the pile. This means that the guide cables are always maintained at a regular distance from the top of the pile, regardless of deviations of the vessel from a vertical position above the pile. One may also use guide cables extending to the previously lowered caisson, in which case, the pile to be lowered is provided with a cross bar through which the guide cables are positioned with respect to the pile.

Inasmuch as the apparatus used for lowering the caisson is different from that used for lowering the pile and the pile driving head, the initiation of pile driving is not such a simple process. At considerable depths it is complicated, if not impossible, to lower guide cables from the vessel and to connect them to the caisson. Any apparatus utilizing this method of pile driving must be comprised of not only a crossbar which may be secured to the pile and which is provided with means for receiving the guide cable, but must be constructed such that the means for securing the crossbar to the pile may support the weight of the pile.

If a crossbar is secured on the pile during the lowering process, the guide cables can be kept at the correct distance from the pile head. This has the advantage that the pile and crossbar can be lowered together, after which the pile driving head may follow. thus the problem of lowering the pile and inserting it into the guide passage of the lowered caisson is incurred only once and may be expedited by known auxiliary means, such as sonar.

It is, of course, also possible to previously position a pile driving head onto the pile and to lower pile and pile driving head together. A combination of this kind however may be so heavy that control thereof may present problems, particularly when the guide cables do not extend to the caisson.

The cross-bar is preferably detachably connected to the pile so that it can be recovered after completion of the pile driving operation. The detaching operation may be effected in various ways, e.g. by long-distance control, explosive bolts and the like, However, in accordance with the present invention a simple solution is provided by the crossbar which is detached from the pile by the pile driving head which can be lowered onto the pile. Then the guide cables and the crossbar are no longer necessary because the pile driving head is in place on the pile. During pile driving operations, the crossbar should not be connected to the pile because the impact loads occurring during the pile driving process might damage the crossbar. The detachable connection may consist of a clamping joint which is released when the housing of the pile driving head has reached the crossbar. When the process of pile driving has been completed, the pile driving device and the crossbar may be recovered together. If the pile driving head has to be lifted before the pile driving process is completed, e.g., in case of repair, the clamping joint can be reactuated so that the crossbar remains attached to the pile.

In a further embodiment, the detachable connection may also consist of a latching pin which is movable in a horizontal direction into and out of an opening in the pile. The pile should have a vertical, slotted hole at such a distance from the underside of the pile driving head when in pile driving position, that the latching element can be unlatched by the pile driving head only when the latching pins are in the upper end of the slotted opening. Unlatching the connection between the crossbar and the pile is only necessary when the crossbar has to be recovered. By pulling the crossbar against the lower side of the pile driving head, the ltch is retracted and the pile driving head as well as the crossbar can be lifted. During the pile driving operation, the pile driving head should not contact the crossbar although the connection of crossbar and pile should not be unlatched. The vertical, slotted hole will then allow movement of the pile such that impact shocks are not transmitted to the crossbar.

The method and apparatus in accordance with the present invention make it possible to carry out pile driving operations at considerable depths without the need of divers, with comparatively simple means and at any angle that is desired because of the technique of placing the pile driving head on the head of a previously lowered pile.

BRIEF DESCRIPTION OF THE DRAWINGS

In the drawings:

FIGS. 7 and 8 are diagrammatic views comparing the prior art with the invention method;

DETAILED DESCRIPTION OF THE PREFERRED EMBODIMENT

Figure 1:
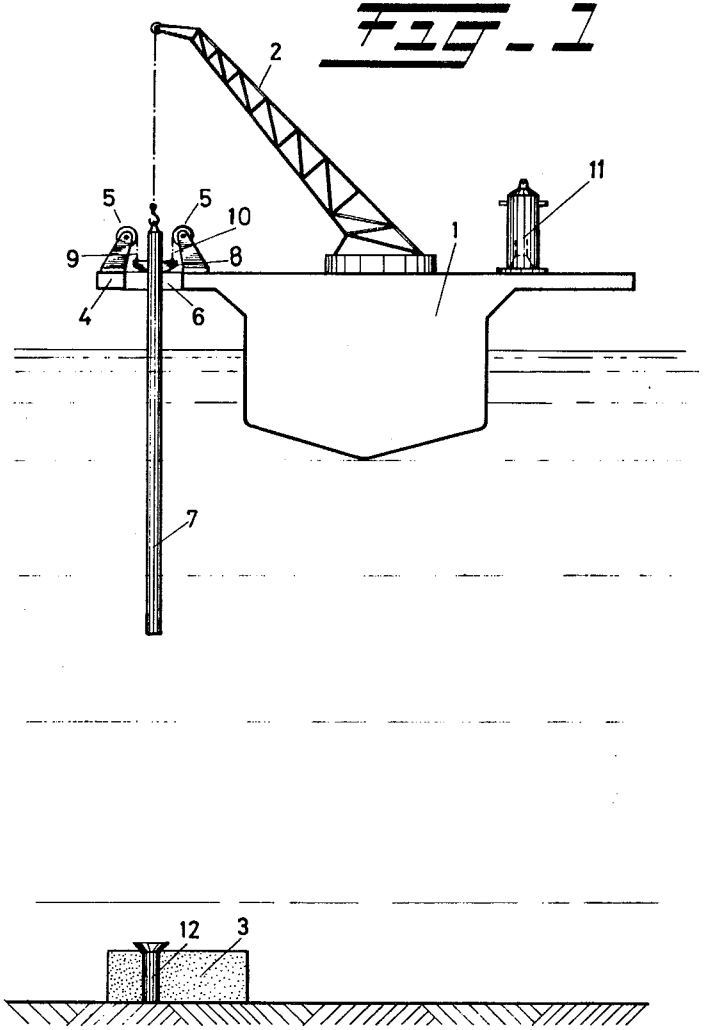

FIGS. 1 through 6 inclusive show a vessel 1 with a hoisting crane 2, said vessel being positioned above an already lowered caisson 3 on the ocean floor. The vessel has a protruding portion 4 on which two winches 5 are disposed on either side of a passage opening 6. FIG. 1 illustrates a pile 7 disposed in opening 6, a crossbar 8 secured to said pile, said crossbar being suspended from the winches 5 by means of cables 9 and 10. Pile driving head 11 is positioned on the deck of the vessel.

Figure 2:
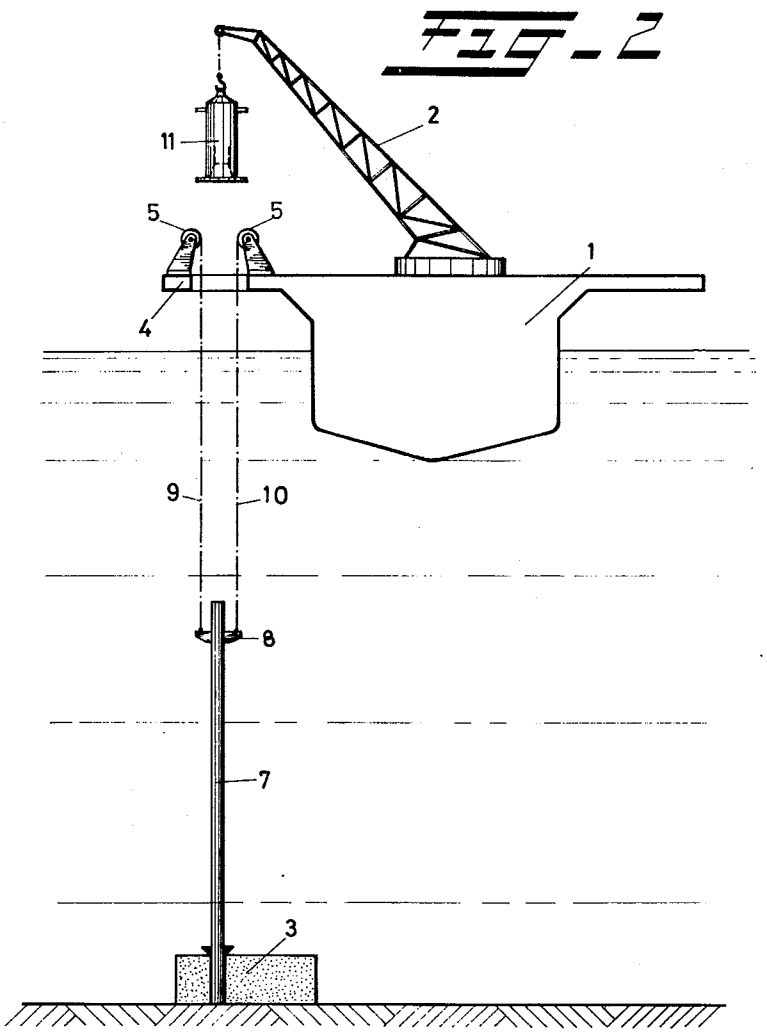
FIGS. 1 through 5 inclusive are diagrammatic views of the various stages of the method in accordance with this invention.
Figure 4:
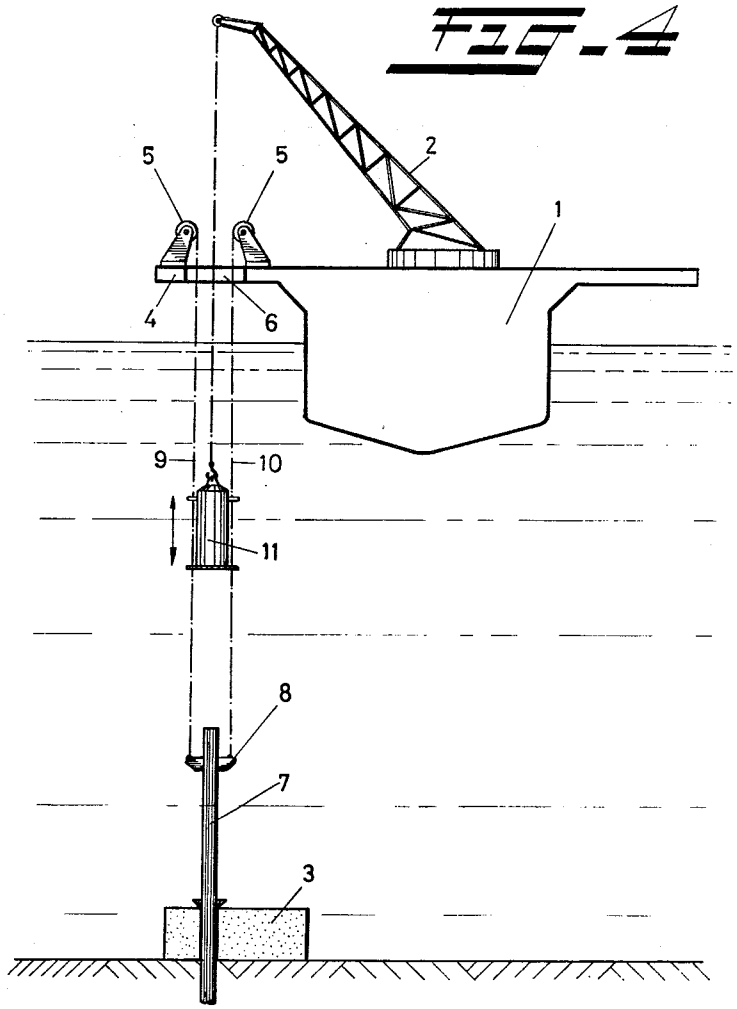
Figure 3:
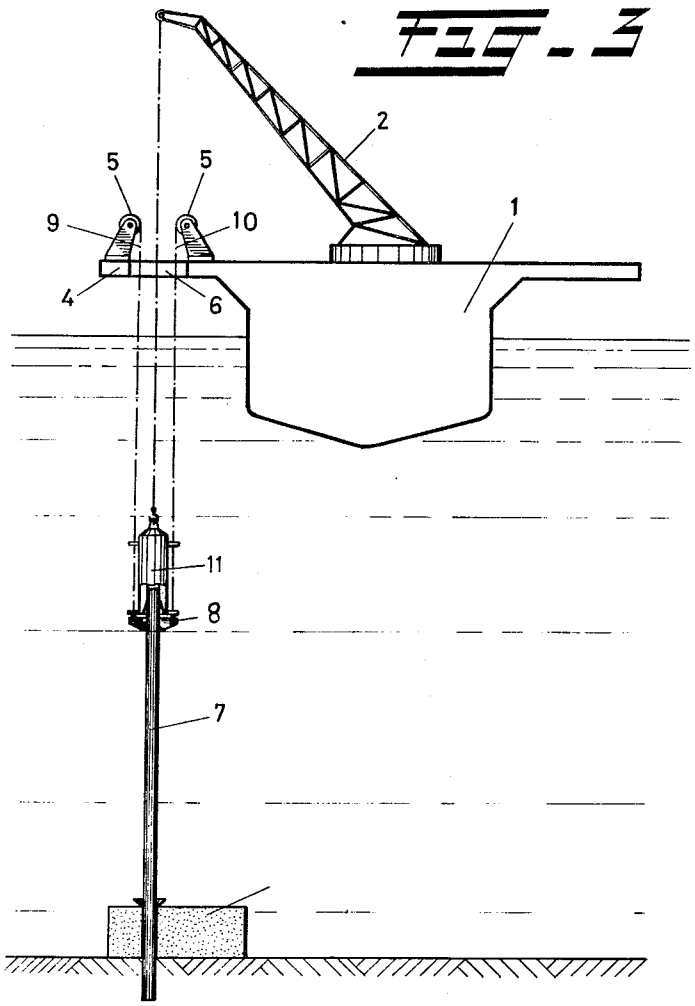
Figure 5:
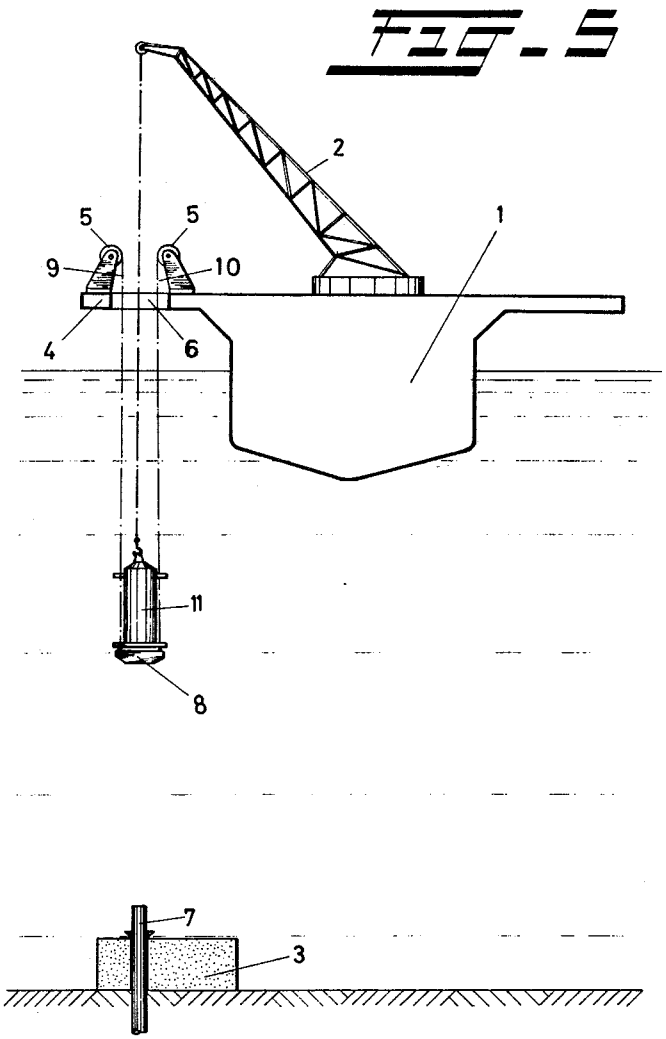

FIG. 2 shows the situation when pile 7 has been lowered and inserted into opening 12 of caisson 3. Lifting crane 2 has now picked up and acts as a means for lowering pile driving head 11. FIG. 3 illustrates how the pile driving head 11 can be lowered with the aid of hoisting crane 2, wherein the pile driving head is guided on cables 9 and 10 and, thus, reaches the head of the pile. FIG. 4 shows the situation when the pile driving operation has to be interrupted and the pile driving head 11 has to be lifted. FIG. 5 shows the situation when pile 7 has been driven and crossbar 8 and pile driving head 11 are being recovered.

Figure 6:
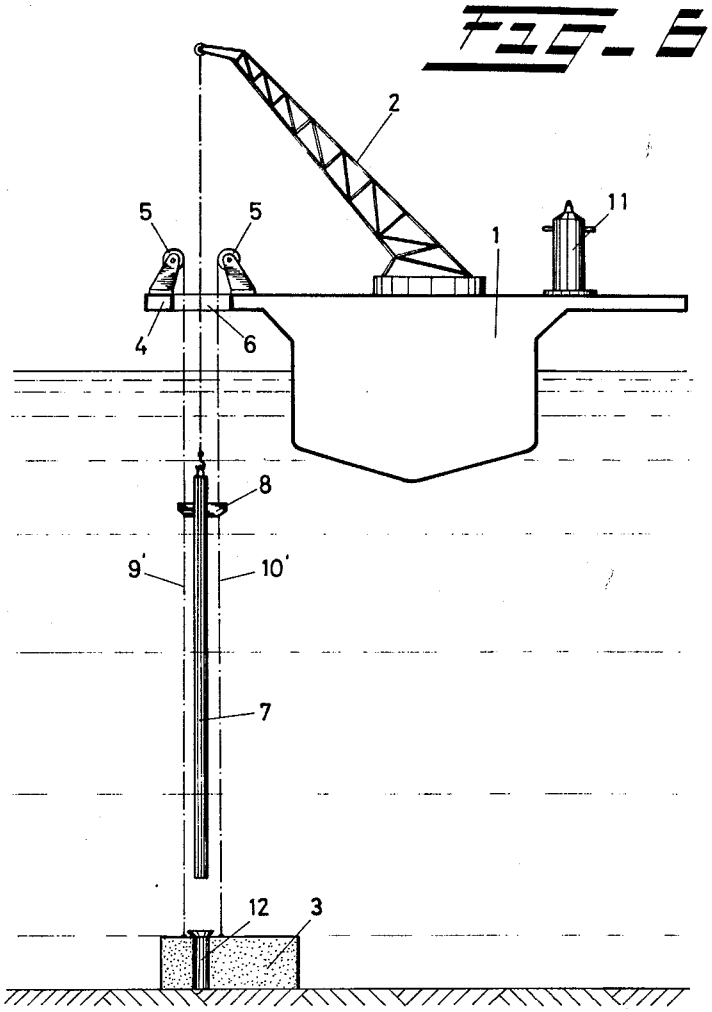
FIG. 6 is a variant of the method illustrated in FIG. 4.

FIG. 6 shows a variant of the illustrations in FIGS. 1 through 5 inclusive. In said variant cables 9' and 10' extend to caisson 3 and are secured thereto so that both crossbar 8 and pile driving head 11 may be guided on the cables.

FIG. 7 shows the problem of prior art methods which are solved with the present invention. When pile 7 is positioned in the opening of caisson 3 and the vessel with cables 9' and 10' has drifted in lateral direction, the pile driving head which is guided downwards along said cables will not reach pile head 13. However, the use of crossbar 8 keeps the cables at the correct distance from the pile head 13 (as shown in FIGS. 1–6) allowing correct pile driving head placement upon the pile.

FIG. 8 shows another aspect of the problem solved with the present invention. It is quite often necessary that piles be driven into the ocean floor at an angle. By making provisions that the guide cables run always in the proximity of the pile head it is possible to lower a pile driving head onto the head of an inclined pile. FIG. 8 shows caisson 3' with an inclined pile 7', a crossbar 8' secured thereto with guide cables 9" and 10". The pile driving head 11' with the funnel-shaped mouth 14 may be lowered to head 13' under any circumstances such that pile driving head 11' is positioned onto the pile and can drive the pile into the ocean floor.

Figure 9:
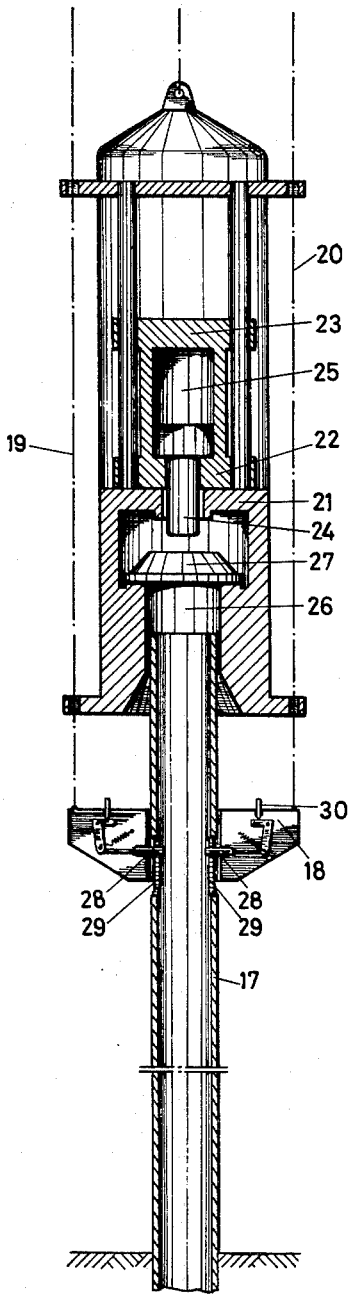
FIGS. 9, 10 and 11 are diagrammatic cross-sections of various positions of the parts with respect to each other when using a pile driving head.
Figure 10:
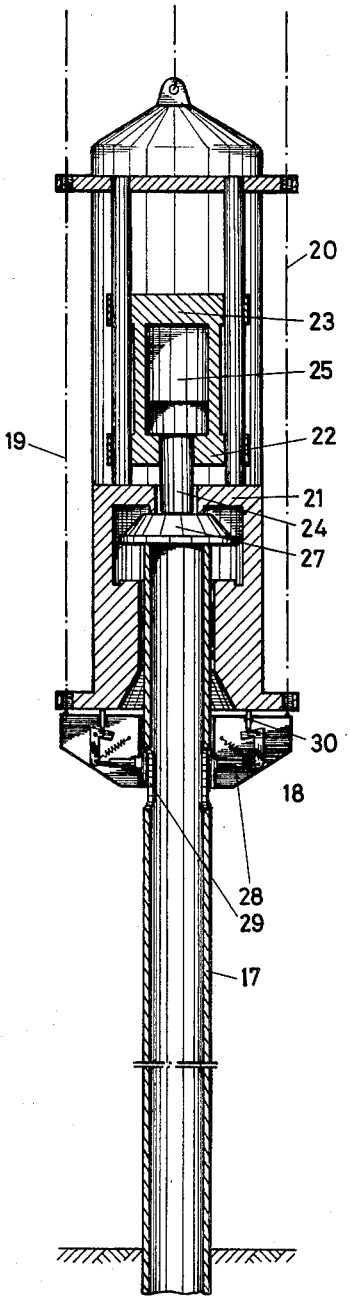
Figure 11:
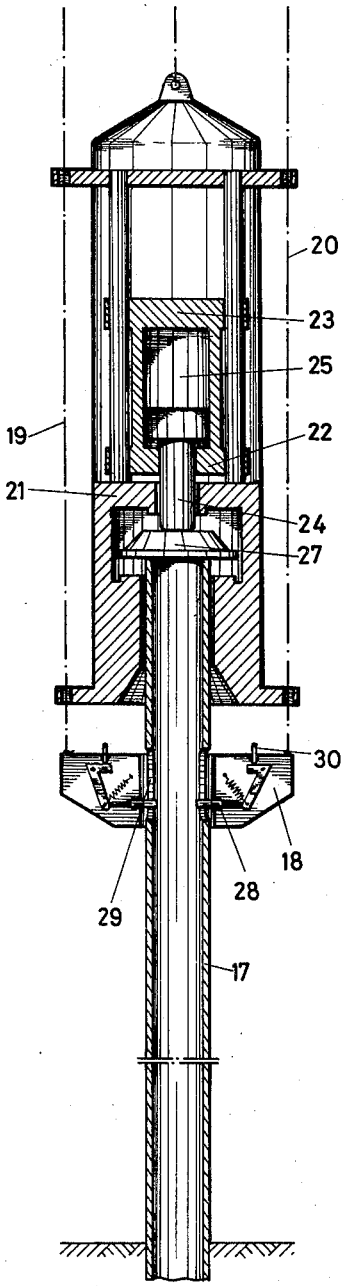

FIGS. 9, 10 and 11 show pile 17 and a crossbar 18 with cables 19 and 20 secured to the crossbar and which provide guidance for the housing 21 of the pile driving head 22. The pile driving head is comprised of a block 23, slidably mounted in the vertical direction, a striking pin 24, and a pre-tensioned pressure pad 25. The housing 21 is comprised of guide sleeve 26 and room for receiving the striking plate 27. FIG. 9 illustrates the condition of the apparatus before the pile driving device has reached the crossbar 13 or when the pile driving device has been removed for some reason.

FIG. 10 shows the position in which the pile driving head has been lowered onto the crossbar 18. Housing 21 is now resting on the head of pile 17 through striking plate 27. The crossbar is provided with latching pins 28 which may be moved into and out of vertical, longitudinal slots 29 by a mechanism (not illustrated in these Figures). Operation of the latching pins 28 may be controlled by remote control and may also be controlled by contact of the crossbar 18 with the housing 21 through the intermediary action of steering pin 30.

In FIG. 9 the crossbar 18 does not carry pile 17 but is still connected. In FIG. 10 the crossbar 18 has been pulled against the lower side of the housing 21, retracting pins 28 so that the crossbar can be removed.

FIG. 11 illustrates pile driving under normal conditions. The crossbar is slightly lowered so that the pins 28 are inserted into the lower end of the longitudinal slots 29. When the pile driving device performs a stroke the pile will now be able to advance downward through the crossbar without contacting pins 28 or transmitting an impact load onto the crossbar if the longitudinal slots are long enough. The strokes of the pile driving device are transmitted to the pile but not to the crossbar as long as the latter is moved downwards at regular intervals along with the pile.

Figure 12:
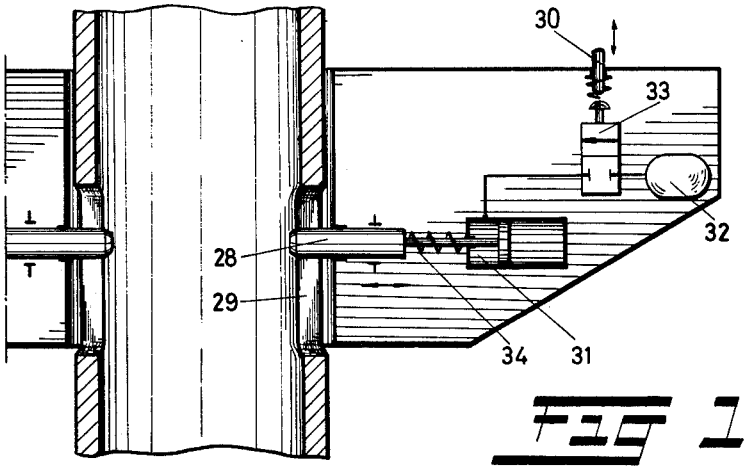
FIGS. 12, 13 and 14 are diagrammatic views of further embodiments of detachable connections between pile and crossbar.
Figure 13:
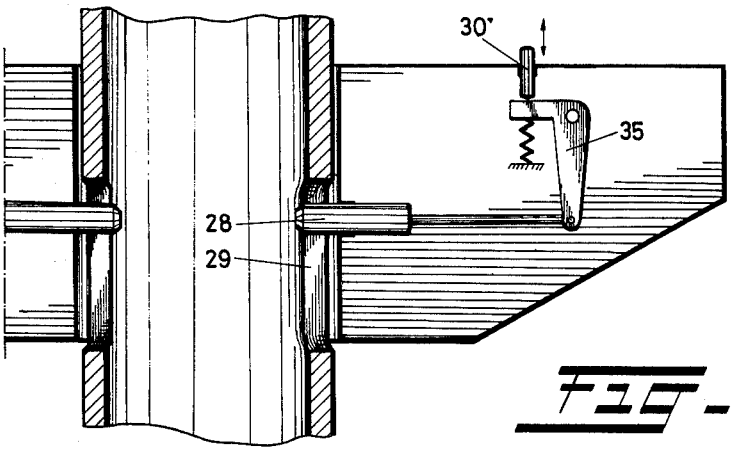

FIG. 12 and 13 show various embodiments for operating pin 28. In FIG. 12 a cylinder 31 is supplied with compressed air from the pressure tank 32 when pin 30 operates valve 33. The piston will be moved by the compressed air and, consequently, pin 28 will be moved out of the longitudinal slot 29 against the pressure of spring 34. FIG. 13 shows a purely mechanical method in that pin 30' is connected to the latching pin 28 via lever 35.

Figure 14:
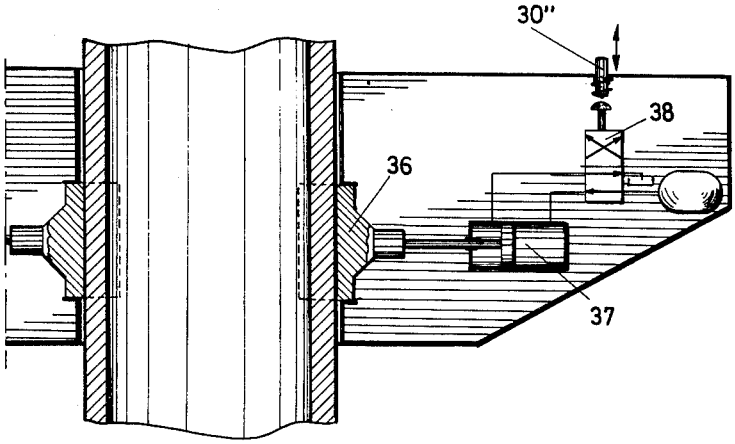
Figure 15:
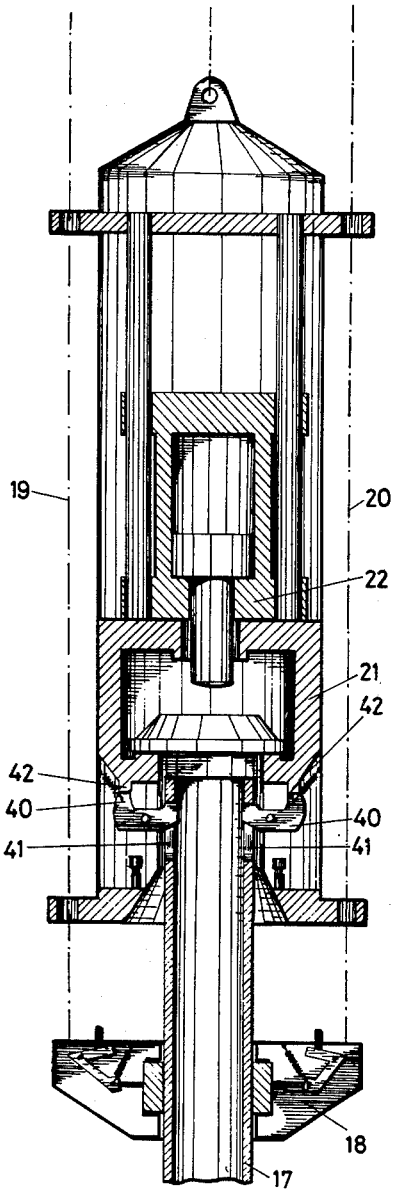
FIGS. 15 and 16 illustrate a further embodiment of a pile driving head.
Figure 16:
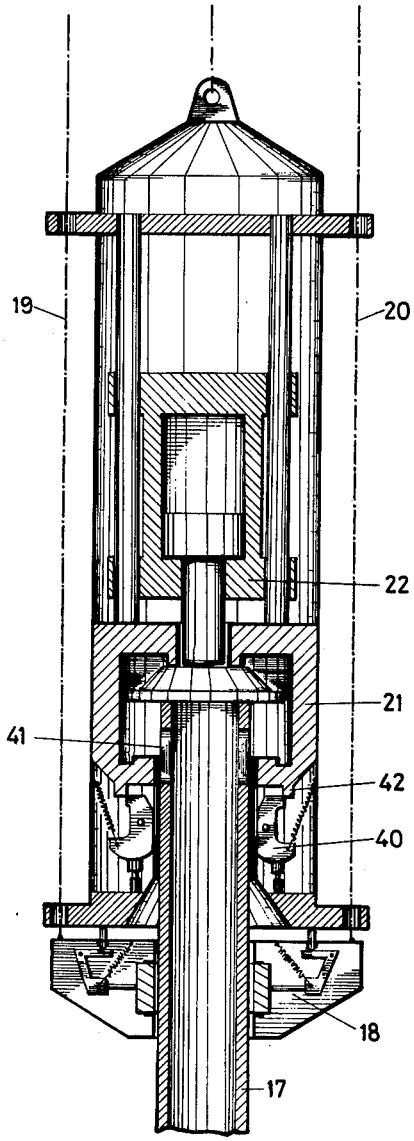

FIG. 14 shows an embodiment in which clamping shoes are used instead of latching pins, the shoes 36 act on the outer surface of the pile to securely grip the pile. The shoes are operated by a double-acting, pneumatic or hydraulic cylinder 37 actuated by pin 30" and slide valve 38. In the position illustrated the shoes 36 are pressed inwardly against the pile. When pin 30' is pressed down and valve 38 operated the shoes are moved away from the pile. FIGS. 15 and 16 show the use of pressure shoes in combination with the pile driving head. FIG. 15 illustrates the apparatus prior to pile driving operations where the crossbar is clamped on the pile. FIG. 16 shows the pile driving operation where the crossbar is pulled against the lower side of the housing of the pile driving device in order to keep the clamping device disengaged so that the pile can slide easily with each impact stroke. In addition FIGS. 15 and 16 show the possibility of lowering the pile, crossbar and pile driving device together where the pile is not only clamped to the crossbar but also to the pile driving head. Tilting latching pawls 40 engage an opening 41 of the pile 17 and are butted against a stop 42 in the housing of the pile driving head. As soon as the pile stops upon reaching the ocean floor, the pile driving head will continue moving downward until pawls 40 are turned into the position of FIG. 16, where the pile is no longer secured. During this movement the pile driving head will contact the crossbar releasing mechanism unclamping the pile from the crossbar.

The present invention is described mainly for the purpose of submersible pile driving at considerable depths. The invention, however, is not restricted thereto and may be used in other circumstances where a device has to be positioned onto any upwardly projecting pile temporarily or permanently.

I claim:

1. In an apparatus for submarine pile driving, said apparatus comprising a pile to be driven into the bottom of a body of water and a pile driving head which rests on the top of the pile after being lowered along guide cables from the surface of the body of water, said apparatus comprising:

crossbar means;

attachment means for detachably mounting said crossbar means to the pile near its top;

said guide cables terminating at said said crossbar means and said attachment means comprising release means carried by said crossbar means and responsive to contact of said pile driving head therewith for releasing said pile from said crossbar means.

2. The apparatus of claim 1 wherein said attachment means comprises means for frictionally engaging the surface of said pile.

3. The apparatus of claim 1, wherein said attachment means comprises:

an opening in said pile;

a latch; and means for mounting said latch on said crossbar means for movement into and out of engagement with said opening.

4. The apparatus of claim 3 wherein said opening is a vertical slotted hole in said pile spaced from the top of said pile such that said release means operates by said latch contacting the upper portion of said vertical slotted hole.

* * * * *